United States Patent [19]

Schwartz

[11] 4,133,316

[45] Jan. 9, 1979

[54] BRASSIERE FRAME

[75] Inventor: Herbert L. Schwartz, Flushing, N.Y.

[73] Assignee: S & S Industries, Inc., New York, N.Y.

[21] Appl. No.: 809,483

[22] Filed: Jun. 23, 1977

[51] Int. Cl.[2] ..... A41C 1/14

[52] U.S. Cl. ..... 128/476

[58] Field of Search ..... 128/476, 465, 469; 2/256, 257

[56] References Cited

U.S. PATENT DOCUMENTS

| | | | |
|---|---|---|---|
| 3,777,763 | 12/1973 | Schwartz | 128/476 |
| 3,799,175 | 3/1974 | Rowell | 128/476 |

*Primary Examiner*—Werner H. Schroeder
*Assistant Examiner*—Doris L. Troutman
*Attorney, Agent, or Firm*—Ladas, Parry, Von Gehr, Goldsmith & Deschamps

[57] ABSTRACT

This disclosure is directed to a protective device for the end of a narrow flat wire and particularly to such device for the end of an arcuate wire in the pocket of a brassiere for framing the lower circumferential portion of a brassiere cup. The ends of the wire are provided with a plastic cap which is secured on the wire by a projection on an edge of the flat wire received in a hole in the cap when the cap is mounted over the end of the wire.

10 Claims, 6 Drawing Figures

FIG. 1
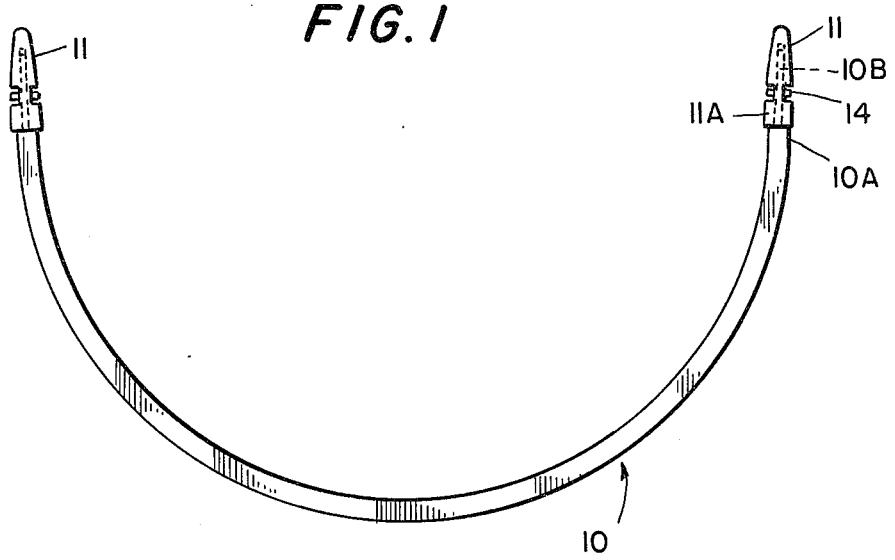
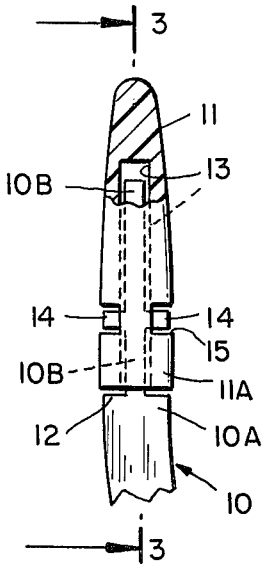
FIG. 2
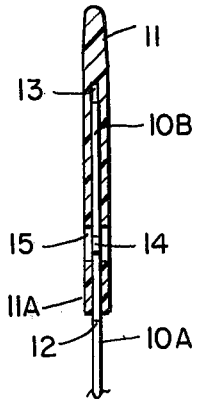
FIG. 3
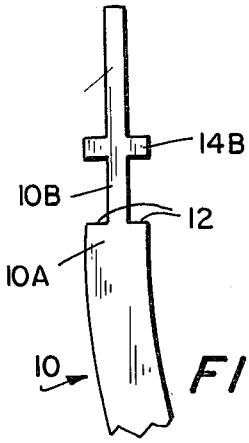
FIG. 4
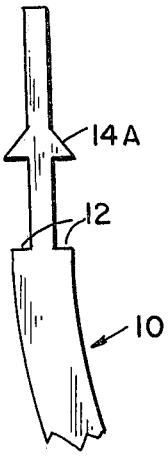
FIG.4A
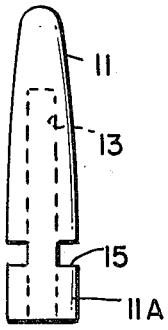
FIG.5

BRASSIERE FRAME

PROBLEM AND THE PRIOR ART

It is known to use a wire frame in the breast pocket of a brassiere for supporting the breast. Such frames generally are formed from wire in an arcuate shape. The end tips of the wire were covered to protect the wearer and/or to prevent the sharp ends from wearing through the material of the brassiere pocket. An earlier covering was provided by dipping the end tips in a resin material. The most recent form of covering used in the industry is a plastic cap detachably secured to a reduced tip end portion of a flat wire. The end of the wire fits into a pocket or bore in one end of the cap and is secured in that position by a holding tab on the flat surface of the wire which is received in a hole in the cap communicating with the pocket. Since the tab was blanked out of the plane of the tip end from the flat surface of the wire, the wire had to have a sufficiently large cross-section to accommodate the forming of the tab therefrom.

OBJECTS

It is therefore an object of this invention to provide an improved brassiere frame in which the ends of the wire are provided with a cap and which wire is narrower and more flexible and resilient.

Another object of this invention is to provide a wire frame which has end caps secured to the ends of the wire which are smaller and are secured to the ends of the wire by an arrangement which permits use of narrow flat wire and accordingly can be accommodated in a smaller or narrower pocket in the brassiere.

It is a further object of the invention to provide a means for securing an end cap on a wire frame which enables use of a narrow flat wire and thereby affords greater comfort to a wearer and is not visible in a garment.

BRIEF DESCRIPTION OF THE INVENTION

The foregoing objects and other features and advantages are attained by a brassiere frame adapted for use in a breast pocket for supporting the breast which comprises an arcuately shaped wire which circumscribes the bottom circumferential portion of a breast pocket. The wire is formed preferably of flat stock material having a rectangular cross-sectional area. The ends of the wire frame are protected by an attachable cover or cap formed of a resilient or plastic material which has an opening at one end for snugly receiving the end of the frame. Complementary means are formed in the tip end of the frame and the associated cap or cover for securing the cap on the frame. The complementary means includes a locking projection formed in an edge of the wire frame and a hole in the cap or cover adapted to receive the locking projection and which communicates with the opening in the cap or cover. The arrangement is such that when the cap or cover is mounted over the frame end the locking projection will enter the opening and pass therethrough until it is aligned with the transverse hole at which point it will protrude through the hole to retain the cap or cover on the frame end.

Other features and advantages of the invention will become more readily apparent when considered in view of the drawings.

FIG. 1 is a plan view of one of a pair of brassiere wires which comprises a frame for a brassiere cup.

FIG. 2 is an enlarged detailed plan view of the tip end construction of the frame of FIG. 1.

FIG. 3 is a vertical section view taken along line 3—3 of FIG. 2.

FIG. 4 is an enlarged detailed plan view of one embodiment of the end of the wire.

FIG. 4A is an enlarged detailed plan view of another embodiment of the end of the wire.

FIG. 5 is an enlarged detailed plan view of the cap cover member.

Referring to the drawings, numeral 10 represents one of a pair of wires forming the supporting frame for a brassiere cup. The frame 10 is of an arcuate configuration which is adapted to substantially correspond to the lower circumferential portion of a brassiere cup. Preferably, the frame 10 is formed of relatively narrow metal wire, such as steel, having a substantially rectangular cross-sectional area. It will be understood, however, that the frame may be formed of other materials, e.g., metals other than steel, plastic, fiber glass, or metal coated with or sheathed in a covering of resilient or plastic material.

The frame 10 defined is generally sewn into a channel or seam circumscribing the lower portion of a brassiere cup. To prohibit the end portions of the frame or wire from wearing through the fabric of the brassiere cup, and also to protect the wearer from the sharp end edges, a protective cap or cover 11 is attachedly secured to the respective end portions of the frame 10.

As shown in FIG. 2, the end portion 10A of the frame 10 is provided with a tip end portion 10B of predetermined shape. The tip end portion 10B has a reduced width which provides end shoulders 12 spaced inwardly from the outermost end of the tip end.

A protective cap or cover 11 is adapted to be fitted to the respective tip ends 10B and said cap comprises an elongate member preferably having a rounded or smooth end portion.

The cap or cover 11 is suitably formed of a resilient or plastic material; as for example, rubber, a resilient plastic, polyethylene and the like. One end 11A of the cover 11 is provided with an opening 13 for receiving the tip end portion 10B of the frame 10. The opening is provided with a depth at least as long as the tip end portion 10B of the wire so that in the assembled position, the end 11A of the cap or cover is disposed in abutting relationship to the shoulders 12. The shoulders 12 thus may function as a stop to limit the insertion of the tip end 10B of the wire into the end 11A of the cap or cover 11. The opening 13 in the cap or cover 11 is preferably dimensioned so as to snugly receive the tip end portion 10B of the wire as shown in FIG. 2. The other end 11B of the cap or cover 11 extends beyond the tip end 10B of the frame and may be tapered or rounded as shown in FIGS. 2 and 5. This facilitates the sliding of the frame 10 through the pocket or seam in the circumferential portion of the brassiere cup.

Means are provided for securing the cap or cover 11 to the end 10B of the frame 10. As shown in FIGS. 2 and 3, a locking projection 14 is provided on the tip end portion 10B. Referring to FIG. 4, the projection 14 extends transversely of the longitudinal axis of the wire and is rectangularly shaped with its free end substantially in alignment with the plane of the edge of the flat wire. An alternative embodiment of the projection is illustrated in FIG. 4A. The projection **14*a* extends transversely of the longitudinal axis of the wire and is triangularly shaped with its pointed end substantially in alignment with the plane of the edge of the flat wire 10. One edge of the triangular projection, preferably the trailing edge, is perpendicular to the long dimension of the tip end portion 10B and the other edge, that is, the leading edge, connects the point of said one (trailing) edge to the tip end portion 10B at an angle to the longitudinal axis of the tip end portion 10B. As shown in FIG. 2, the cap or cover 11 can be readily slipped onto the end 10B of the frame 10 by inserting the end 10B of frame 10 into opening 13 in the end of cap 11**.

A laterally extending aperture 15 is formed in the cap or cover 11 which communicates with the opening 13. The aperture 15 is located at a position so as to be in register with the locking projection 14, **14*a* when the cap or cover 11 is in abutting position against shoulders 12 on the frame 10, as shown in FIG. 2**.

The resilient or plastic material of the cap or cover 11 is sufficiently flexible to permit entry into opening 13 of the locking projection 14, **14*a* and passage therethrough until the locking projection reaches aperture 15 at which point the projection 14, 14*a*** will project through the aperture and secure the cap in its seated position on the tip end.

The passage of the locking projection **14*a* through opening 13 could be facilitated to some extent by the angular leading edge as shown in FIG. 4A, but the projection may be formed in a rectangular shape as shown in FIG. 4**, and could also be made angular with the leading edge perpendicular to the longitudinal axis of the wire (not shown).

Likewise, the resilient or plastic material of the cap or cover 11 may be sufficiently soft or pliable to permit the cap to be readily sewn to the brassiere cup, if desired, by a sewing needle passing directly through the outermost end of the cap or cover 11 beyond the end of the tip end of the wire, to restrict relative movement between the tip ends of the frame 10 and the brassiere channel or pocket into which it is positioned.

While the invention has been described with respect to the embodiments illustrated it will be readily understood that variations and modifications may be made without departing from the spirit or scope of the invention.

I claim:

1. A brassiere frame adapted for use in a breast pocket for supporting the breast comprising an arcuately shaped wire for circumscribing the bottom circumferential portion of a breast pocket, and means for covering the opposed tip ends of said wire, said latter means comprising a flexible member having an opening extending into one end thereof adapted to snugly receive the end portion of the wire, and complementary means formed on said wire and said cover member for securing said cover member to said wire, said complementary means comprising means defining a hole in said cover member disposed in communication with the opening in the end thereof and extending substantially laterally of said opening, and a locking projection adjacent the end of said wire received in the hole in the cover member, said wire having a substantially rectangular cross-section and said locking projection being formed in an edge of said wire.

2. The invention as defined in claim 1, wherein the cover is positioned with two diametrically opposed holes, and the wire has a locking projection on each edge thereof received in one said hole.

3. The invention as defined in claim 1, wherein the end of the wire has a reduced tip portion, and the locking projection extends from an edge of said reduced tip portion.

4. The invention as defined in claim 1, wherein the locking projection is rectangular.

5. The invention as defined in claim 1, wherein the locking projection has one edge facing the outermost end of the wire substantially perpendicular to the long axis of the wire and another edge at an angle to said long axis, thereby forming a pointed tip adapted to be received in the hole in said cover member.

6. The invention as defined in claim 1, wherein the wire is coated with a resilient or plastic material.

7. The invention as defined in claim 1, wherein a sheath of resilient or plastic material is provided covering the wire.

8. The invention as defined in claim 1, wherein the hole in the cover member is formed by a cut-out portion in an edge thereof.

9. A brassiere frame adapted for use in a breast pocket for supporting the breast comprising an arcuately shaped wire for circumscribing the bottom edge of a breast pocket, means for covering the opposed tip end of said wire, said means comprising a flexible plastic cap having an opening in one end thereof for snugly receiving the end portion of said wire, the end of said wire having a reduced tip end defining a shoulder stop, said reduced tip end being adapted to be positioned in the opening in said cap whereby the open end of the cap abuts the shoulder stop, said wire having a substantially rectangular cross-section with its longer dimension extending radially of the curvature thereof, locking means on said tip end for securing the cap on the end of the wire, said locking means comprising a projection formed in an edge of said wire intermediate the outer end and the shoulder stop, and a hole in the wall of the cap communicating with the opening which receives said locking projection when the tip end is seated in the cap.

10. A protective device for the end of a flat wire, adapted particularly for use on a breast supporting wire in a brassiere, comprising an elongate cover member of resilient or plastic material having an internal bore of rectangular cross-section extending from one end of said cover member, and a hole extending transversely through a wall of the cover member to a narrow side of said rectangular cross-section of said bore, said wire being a narrow flat rectangular wire having a shaped tip portion at the end thereof, said tip including a locking projection extending from an edge of the wire and being received in the hole of said cover member when the tip portion is positioned in the bore in said cover member.

* * * * *